United States Patent [19]

Fricker

[11] Patent Number: 4,744,191

[45] Date of Patent: May 17, 1988

[54] APPARATUS FOR THE ANCHORAGE OF SLABS

[76] Inventor: Siegried Fricker, 30-34 Wurmberger Strasse, 7135 Wiernsheim, Fed. Rep. of Germany

[21] Appl. No.: 900,406

[22] Filed: Aug. 26, 1986

[30] Foreign Application Priority Data

Aug. 28, 1985 [DE] Fed. Rep. of Germany ..... 3530694

[51] Int. Cl.[4] ..... E04F 13/08

[52] U.S. Cl. ..... 52/702; 52/235

[58] Field of Search ..... 52/235, 702, 712, 698

[56] References Cited

U.S. PATENT DOCUMENTS 4,607,472 8/1986 Pointner ..... 52/235

FOREIGN PATENT DOCUMENTS 0132003 1/1985 European Pat. Off. .
230783 1/1985 Fed. Rep. of Germany .
1242995 8/1960 France ..... 52/235
1241861 8/1960 France ..... 52/235

*Primary Examiner*—John E. Murtagh
*Attorney, Agent, or Firm*—Foley & Lardner, Schwartz, Jeffery, Schwaab, Mack, Blumenthal & Evans

[57] ABSTRACT

Apparatus for anchoring slabs, such as natural stone slabs, masonry wall blocks or the like, to an anchorage base, e.g. a building, comprising an angular holder having two spaced struts. Each strut includes a vertical holding leg and a horizontal supporting leg. The struts are arranged perpendicular to the surface of the anchorage base. The struts are braced together and combined with an anchor for anchoring the holder in the base, and a support member for supporting the slabs or the like. The holder and connected elements can be mass produced inexpensively by punching or stamping flat material, require no complex shaping work, exhibit a minimum weight with high load-bearing capacity, and can be easily adjustable.

14 Claims, 11 Drawing Sheets

APPARATUS FOR THE ANCHORAGE OF SLABS

BACKGROUND OF THE INVENTION

The invention relates to an apparatus for the anchorage of slabs, in particular natural stone slabs, aluminum plates, masonry or the like, to the anchorage base, with an angular holder which exhibits a vertical holding leg and a horizontal supporting leg.

In a known apparatus of this type (European Preliminary Published Specification No. 132,003), the vertical holding leg consists of parallel flat holding struts which are perpendicular to the surface of the anchorage base and between which an anchorage element, in the form of a screw bolt connection, is provided. The two flat holding struts consist of a flat strip which is bent off at the top in hairpin shape and whose lower sections interact with bracket-like bent parts, which form the horizontal supporting leg, the hairpin-shaped bent holding leg being bent off by its lower parts in a similar manner in the direction of the horizontal supporting leg and connected to the latter by riveting or welding to form a flexurally rigid apparatus. The horizontal supporting leg bent like a bracket exhibits an internal thread in which the threaded bolt of a horizontally adjustable support is arranged. The free end of the support is designed with a mount for the slab to be supported, a vertical holding pin being arranged at the free end of the support, which holding pin engages in a corresponding recess of the wall slab.

The support, borne in round, horizontal supporting legs bent like eyes, can thus be infinitely variably adjusted horizontally, so that the slab held in front of the actual masonry can be precisely adjusted in its lateral distance from the masonry.

The known apparatus likewise has a vertical setting capability for the perpendicular adjustment of the height of the slab. It comprises the provision of a toothing on the wall side of the two flat holding struts, which form the vertical holding leg, which toothing interacts with a plate provided with toothing and resting on the surface of the masonry in such a way that the apparatus can be vertically adjusted as a whole.

A disadvantage of this known apparatus is that it requires a considerable complexity in its production. Although the vertical holding leg can be punched out of a simple sheet metal strip, the tabs and toothing provided on these sheet metal strips necessitate a considerable expenditure of material, and an infinitely variable setting is not possible. A further complexity from a production viewpoint is that the vertical holding leg has to be bent off several times, necessitating expensive bend-shaping on relatively expensive bending devices or bending machines. A further complex and elaborate operation is the production of the horizontal supporting leg, which has to be bent into an almost closed holding eye for the horizontally adjustable support parts. Finally, the vertical holding leg and the horizontal supporting leg have to be firmly connected to each other by means of riveting and/or welding in such a way that the apparatus as a whole has adequate load-bearing and flexural rigidity.

SUMMARY OF THE INVENTION

The invention is based on the object of designing the apparatus of the type mentioned in such a way that it can be produced cheaply without expensive and complex shaping work from flat material and with an optimally low weight of materials. The apparatus is, furthermore, designed in such a way that it can be assembled and adjusted quickly and easily.

Owing to the fact that, according to the invention, both the horizontal supporting leg and the vertical holding leg consist of two parallel struts, which can be stamped out of level flat material, a simple, cheap and material-saving production of the entire apparatus results, in particular if the vertical holding struts and the horizontal supporting struts are arranged respectively only in a single, that is in the same, vertical plane. Consequently, the apparatus consists substantially of angular flat punched parts which, in their assembled position, are perpendicular to the surface of the masonry and are connected to each other by corresponding connecting parts, which are preferably likewise designed as flat parts to form a stable, flexurally rigid unit.

A particularly simple and inexpensive embodiment of the invention results if the two mutually parallel horizontal supporting struts and the vertical holding struts interact respectively, with the latter being punched out as a whole from flat iron as a homogeneous flat angle part. In this case there is no need for a special connection of the vertical leg and the horizontal leg, for example by welding corresponding to a mitered edge or by a positive connection provided in the region of the miter, e.g. a toothing or the like. A connection of the two mutually parallel angular holders is inexpensive to produce, simple and flexurally rigid if the vertical holding struts and/or the horizontal supporting struts are stably connected to each other by bracings, for example by simple flat plates, bolts, other transverse members, or by weldings. In this instance, the connection for the horizontal supporting struts may simply comprise a horizontal support plate which rests on these supporting struts and is horizontally displaceable on these supporting struts by means of a releasable screw connection with a corresponding counter plate.

However, of particular advantage, owing to its stability, simplicity and load-bearing capacity, is a connection of the supporting struts in which preferably spaced-apart plates are provided which are connected positively or by welding to the parallel supporting struts. In this instance, two mutually parallel plates may serve at the same time as bearing plates for receiving the displaceable support, in particular its threaded part.

As these connecting parts are simple plates, which are likewise merely produced by punching from thin and cheap flat material, these simple connecting parts do not substantially increase the weight of the overall apparatus, so that they are characterized not only by their simple manufacture, but also by a minimum expenditure of material.

The production of the apparatus according to the invention from punched parts makes it possible, in a simple, cost-saving way, to punch simple semicircular recesses in the narrow edges of the holding struts facing the anchorage base, which recesses make possible a particularly simple vertical adjustment of the apparatus. Instead of the known adjustment plate with toothing, described above, or instead of a likewise known setting plate with an oblique elongate hole to be inserted between the vertical holding leg and anchorage base to create a simple, infinitely variable adjustment of the entire apparatus, the invention provides for the setting plate to be designed as a continuous wedge plate with one border bent off toward the holder, whose outer edge is provided for engagement in corresponding supporting recesses on the edges of the vertical holding struts facing the masonry and whose lower edge runs at a given angle obliquely to the horizontal border. In this arrangement, the border may be bent off at an angle which is less than 90°. The lower edge of this wedge plate designed according to the invention thus forms a bearing edge on the anchorage element, which may be provided, for example, as a dowel, screw bolt connection or the like.

If, according to a further feature of the invention, each vertical holding strut is provided in its lower region with a projecting lug, an extension or the like, which forms an approximately punctiform contact on the anchorage base, the result is that the apparatus transfers the forces absorbed by it to the anchorage base in the manner of a three-point bearing. This is of particular advantage in the case of the design of the wedge plate according to the invention since the forces of weight are not bending forces acting on the anchorage or into the anchorage base, but are transferred directly as shearing forces onto the anchorage element. The latter, and thus the apparatus itself, therefore can be produced with less material and consequently more inexpensively on account of the absence of disadvantageous bending forces.

Furthermore, the design of the spline according to the invention considerably simplifies the assembly, in particular the infinitely variable adjustment of the apparatus on the anchorage base in comparison with known apparatuses. If, for example, the bore set into the anchorage base has not been made dimensionally accurate, such a dimensional inaccuracy, as well as, tolerances on the anchorage base itself, can be compensated readily and simply by the wedge plate according to the invention by simple lateral adjustment of the wedge and thus infinitely variable vertical adjustment of the apparatus. Simple insertion of the spline between the wall and the angularly designed apparatus causes the latter to be displaced infinitely variably in a vertical direction. The shearing forces thus act directly at the edge of the dowel or on a threaded bolt, without any bending stresses occurring, as is the case, for example, if it were necessary for the rear setting plate to be moved forward, in other words away from the wall, during the adjustment operation. At the same time the spline according to the invention makes possible the three-point bearing of the apparatus on the anchorage base, since, in interaction with the projecting lugs likewise provided on the rear sides, the apparatus rests as a whole by its holding angle directly with the recesses on the bent-off border of the wedge plate. Underneath this saddle-like bearing, each holding leg, and thus the entire apparatus, is supported at two further points with respect to the anchorage base on account of the lugs, tabs or the like projecting toward the anchorage base in the lower region of the vertical holding legs. Thus, the vertical line of adjustment can be predetermined depending on the dimensioning of the wedge plate and, corresponding to the thickness, the size of the wedge plate and the dimensioning of the projecting lugs or extensions, virtually all tolerances occurring in practice on the building unit can be taken into account. In particular, the unevennesses occurring on the surface of the anchorage base can be compensated for depending on the intended use of the apparatus, with the three-point bearing also providing a direct support of the apparatus in the lower region without an additional shim being necessary.

The apparatus according to the invention can be used to advantage also in special installation cases, for example if vertical brick walls, which usually do not take adequate dowelling, are provided between concrete intermediate floors. In such cases, the slabs one on top of the other in front of the brick wall are supported on a single angle underneath, which is bolted or dowelled in the concreted floor structure. A disadvantage with these known apparatuses is that they do not have any horizontal adjustment capability.

The apparatus according to the invention can be designed for such installations in a simple way such that, in fastening the apparatus in the floor region, the forces of the weight of several slabs one on top of the other are absorbed and there is a horizontal adjustment capability. An apparatus according to the invention which is suitable for supporting several slabs and for various distances between the slabs to be supported and the anchorage base is characterized according to the invention by the angular holders being formed from simple level punched sheet metal strips, in which the vertical holding legs are kept the same size, while the horizontal legs exhibit different lengths, corresponding to the given wall distances. Preferably, the arrangement here may be such that a supporting plate which is displaceable away from the wall is provided on the horizontal supporting legs, which plate may be designed thin in relation to the horizontal supporting struts and is retained displaceably on the supporting struts by means of a detachable screw connection. In such an embodiment, the forces of weight go directly onto the supporting struts, whereby only slight bending forces occur, making this design suitable for the absorption of particularly high forces of weight. In this arrangement, the slabs are retained, as known per se, by vertical pins which are provided on the free end of the displaceable plate. Thus a system for concreted floors is created which can be used advantageously for all distances encountered in practice between the slabs of a wall lining and the outside of a construction, since the angle holders of the invention are suitable for supporting several slabs one on top of the other. Owing to corresponding length graduations of the horizontal legs with displaceable bearing plate thereon, the arrangement can be adapted to virtually all installations, which previously was only possible by the fabrication of specially constructed configurations.

BRIEF DESCRIPTION OF THE APPLICATION DRAWINGS

The subject matter of the invention is explained below in particular reference to the application drawings in which:

FIG. 1 shows the basic design of an apparatus according to the invention, in perspective;

FIG. 1*a* shows an apparatus identical to FIG. 1 except for additional bracing parts in the wall-side part of the apparatus;

FIG. 1*b* shows a partial perspective view of FIG. 1*a*, seen from the rear;

FIGS. 2*a*, 2*b* and 2*c* show an embodiment of the invention bridging various distances between the anchorage base and slab lining for mounting several slabs one on top of the other;

FIG. 3*a* shows a modified apparatus mounted on the anchorage base;

FIG. 3*b* shows in plan view the spline designed according to the invention, which may be connected to FIG. 3*a* apparatus by a plastic cord or the like;

FIG. 4*a* the angle holder according to FIG. 1, in side view;

FIG. 4*b* shows a front view of the angle holder of FIG. 4*a*, but with a fitted bearing plate;

DETAILED DESCRIPTION OF THE PREFERRED EMBODIMENTS

Figure 1:
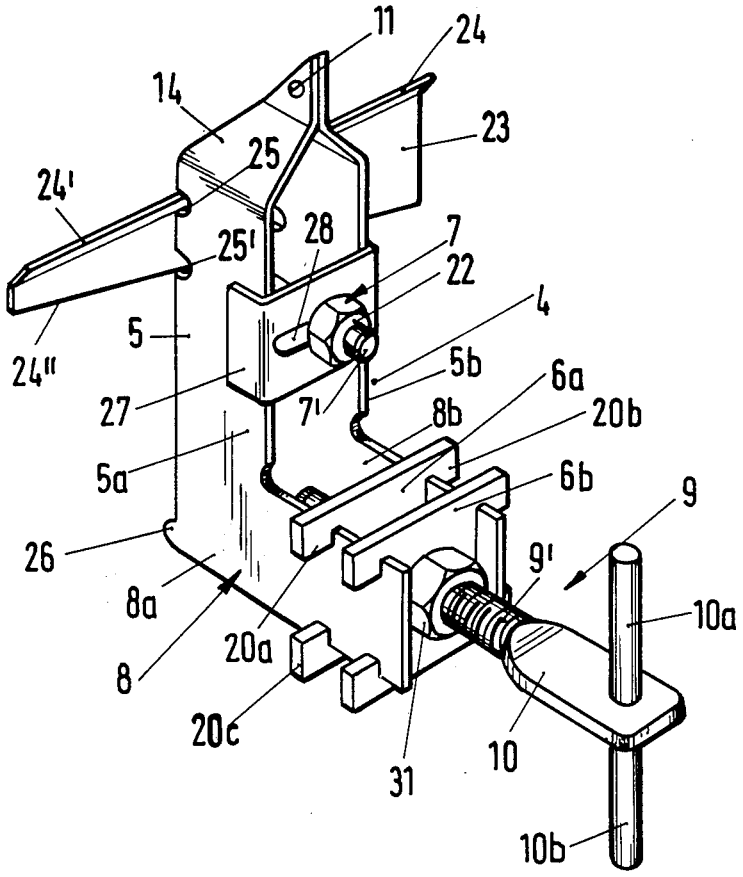
Figure 1A:
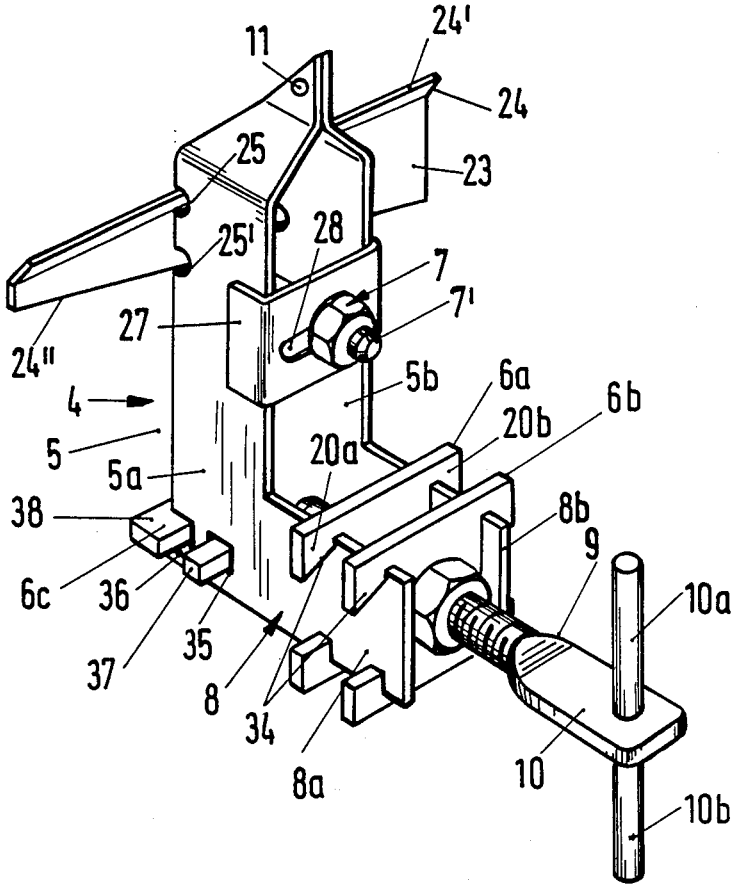
Figure 3A:
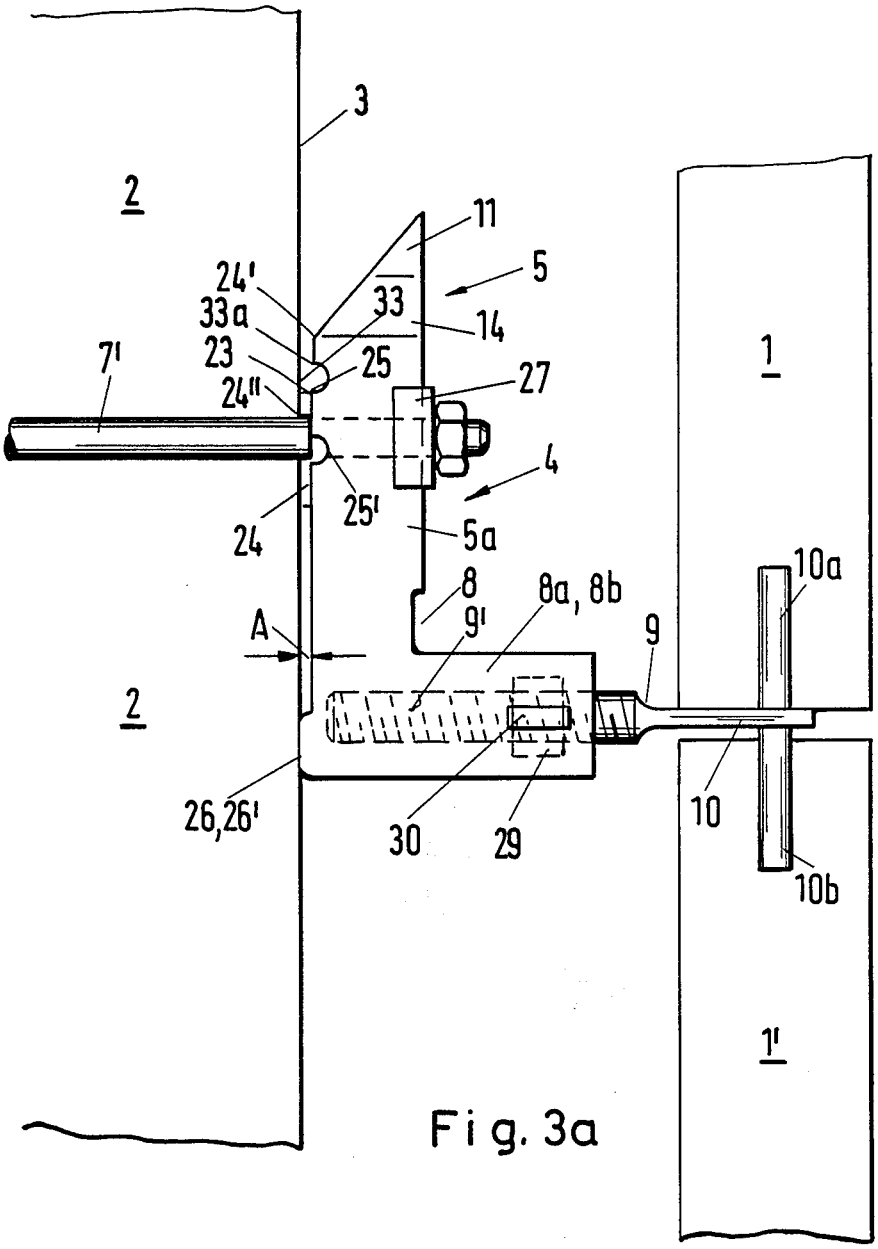

It can be seen from the drawings, in particular FIGS. 1, 1*a* and 3*a*, that the apparatus permits the anchorage of slabs 1 which are fastened at a distance in front of an anchorage base 2 (FIG. 3*a*). The apparatus must therefore not only absorb the forces of weight of the slabs 1, but also the loads caused by weather, by suction or pressure and other wind loads or the like. The apparatus consists of an angular holder 4 having a vertical holding leg 5 and a horizontal supporting leg 8. The vertical holding leg 5 has two parallel flat holding struts 5*a*, 5*b* perpendicular to the surface 3 of the anchorage base 2, between which holding struts passes the anchorage element 7, for example a dowel, a screw bolt connection or the like. For this purpose, it is advantageous to provide a U-shaped clip 27 consisting of flat iron, which extends over the holding struts 5*a*, 5*b* and is formed with an elongated hole 28 through which the dowel or the screw bolt 7' extends, with tolerance compensation in the horizontal direction.

The horizontal supporting leg 8 likewise consists of two mutually parallel supporting struts, 8*a*, 8*b* of flat iron. These horizontal supporting struts 8*a*, 8*b* and the vertical holding struts 5*a*, 5*b* consist of substantially flat punched strips and together form the angular holder 4 in accordance with the embodiments according to FIGS. 1 to 6, in which the holding struts 5*a* or 5*b* and the associated supporting struts 8*a* or 8*b* are respectively in the same vertical parallel planes. The holding struts 5*a*, 5*b* and/or the horizontal supporting struts 8*a*, 8*b* are connected in a suitable way to each other by bracings to form a stable, flexurally rigid apparatus. This may be accomplished by detachable, for example screwable, connecting or bracing parts or by bracings to be welded in or fastened in another way. In the embodiments of FIGS. 1 to 7, the holding legs 5*a*, 5*b* are bent toward each other at 14 and connected to each other by the weld 11, for example, a spot welding. The bracing of the holder 4, consisting of thin and flat angular punched parts, is performed according to the embodiments of FIGS. 1 and 1*a* by at least one, and preferably two, spaced-apart parallel bearing plates 6*a*, 6*b* which firmly connect the supporting struts 8*a*, 8*b* to each other.

Figure 1B:
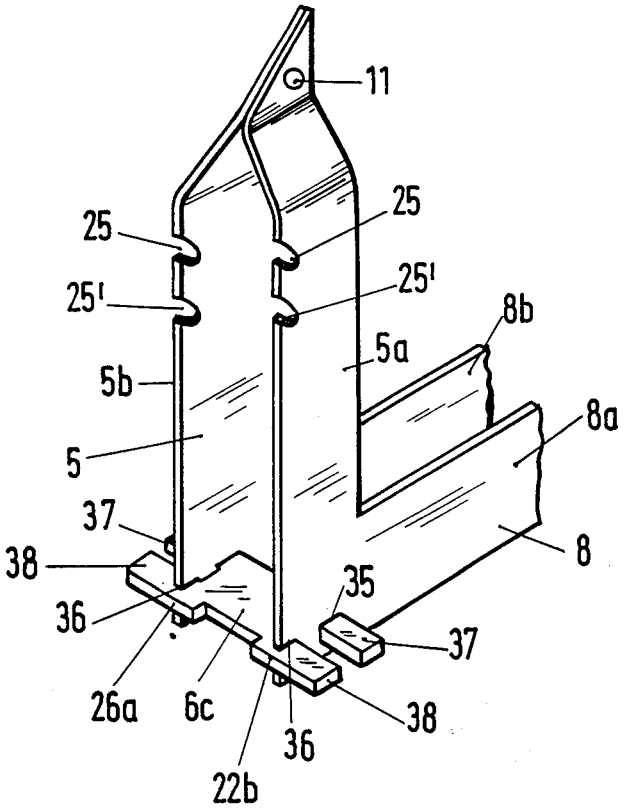
Figure 6:
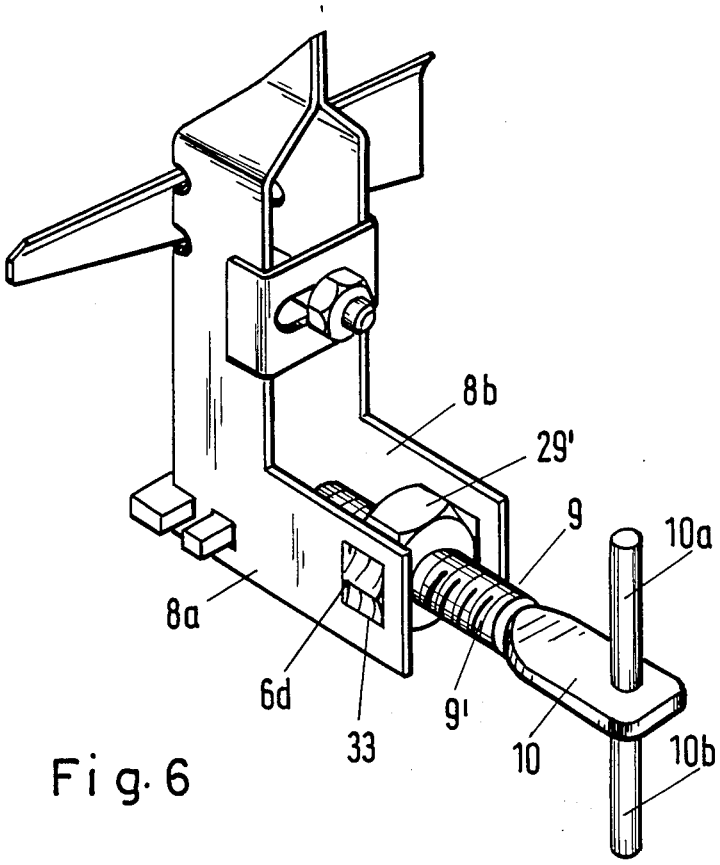
FIG. 6 shows an embodiment corresponding to FIG. 3*a*, in perspective representation with an alternate design of the bracing.

For high loads or if the holding and supporting struts consist of thin sheet metal parts, according to the embodiments of FIGS. 1*a*, 1*b*; 2*a* to 2*c* and FIG. 6, an additional bracing 6*c* in the form, for example, of a likewise approximately H-shaped punched part 6*c* may be provided in the rear part, in other words on the anchorage base side, of the angular holder 4.

Figure 2A:
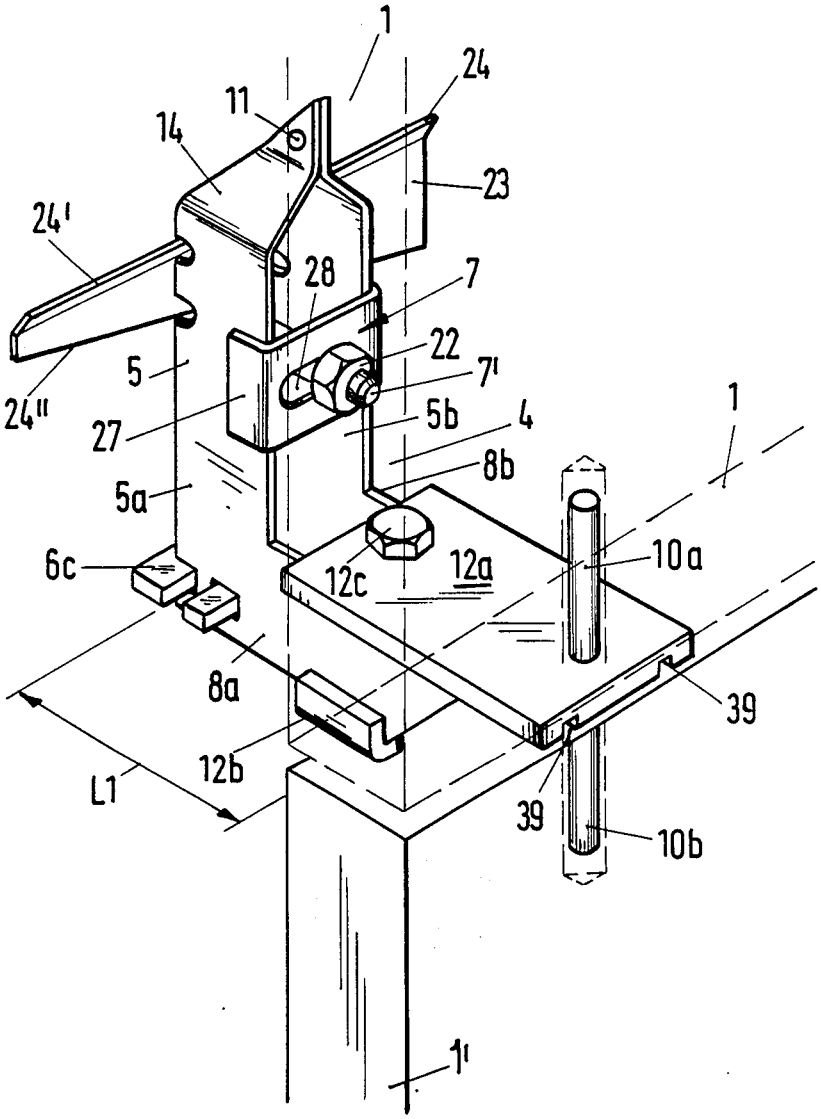
Figure 2B:
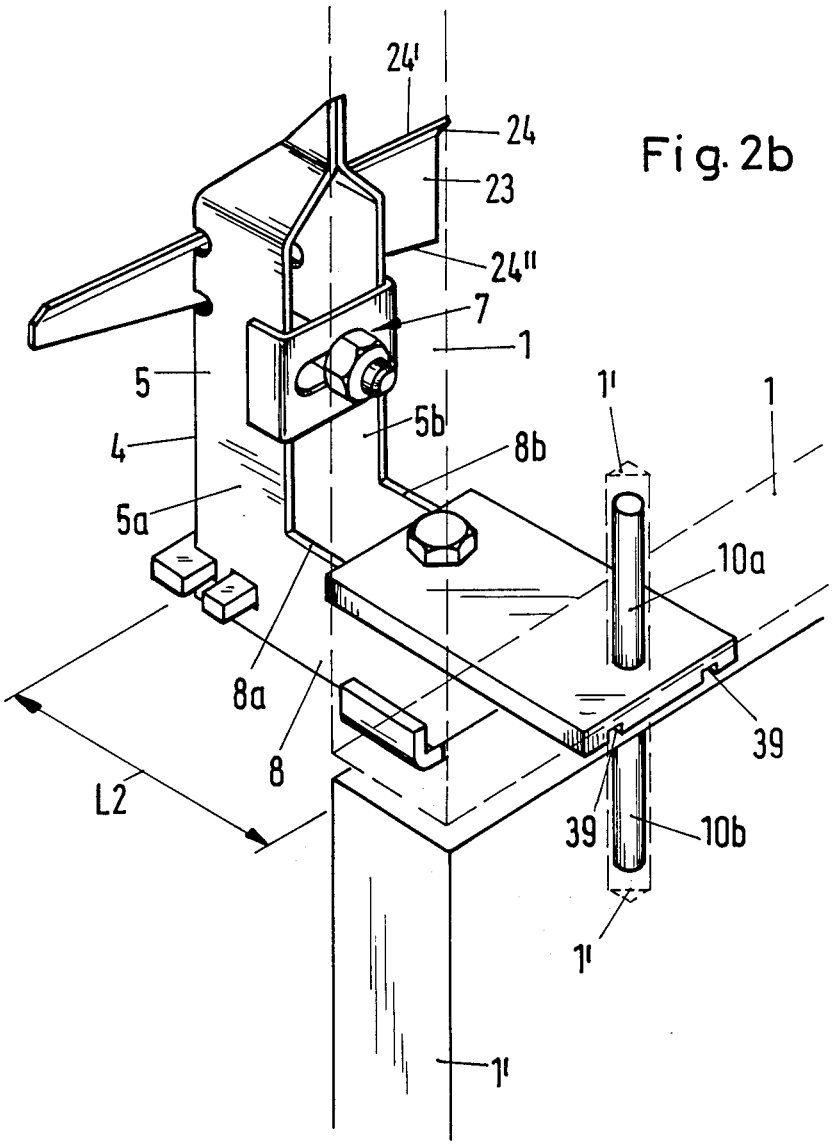
Figure 2C:
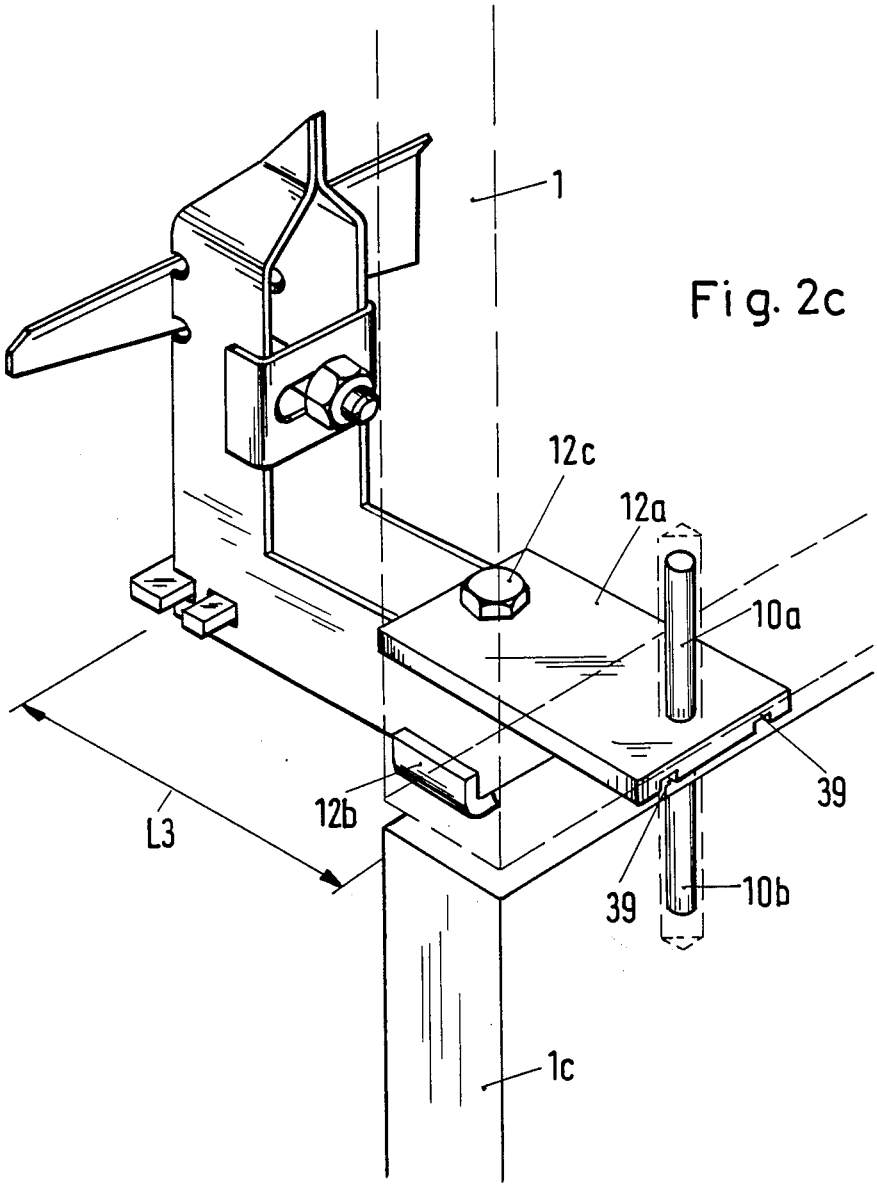

In FIG. 3*a*, the bracing is formed by a sleeve 29 designed like a wing with welded-in or pressed-in transverse pieces 30. In the examples of FIGS. 2*a* to 2*c*, the bracing consists of an upper plate 12*a*, a lower clip 12*b* and a screw 12*c* connecting the two.

Thus, in the embodiment according to FIG. 3*a*, a transverse web is provided as bracing of the supporting struts 8*a*, 8*b*, which web consists of two transverse pieces 30 which are connected on either side of the threaded sleeve 29 to the latter and to the inner surfaces of the supporting struts 8*a*, 8*b*. The sleeve 29 serves simultaneously as a bearing for the support 9, which extends in the horizontal supporting leg 8 displaceably toward the anchorage base 2.

In the embodiment of FIG. 6, the bracing is formed by a welded-in nut 29', which is welded into opposite recesses of the supporting legs 8*a*, 8*b* at 6*d*.

Figure 7:
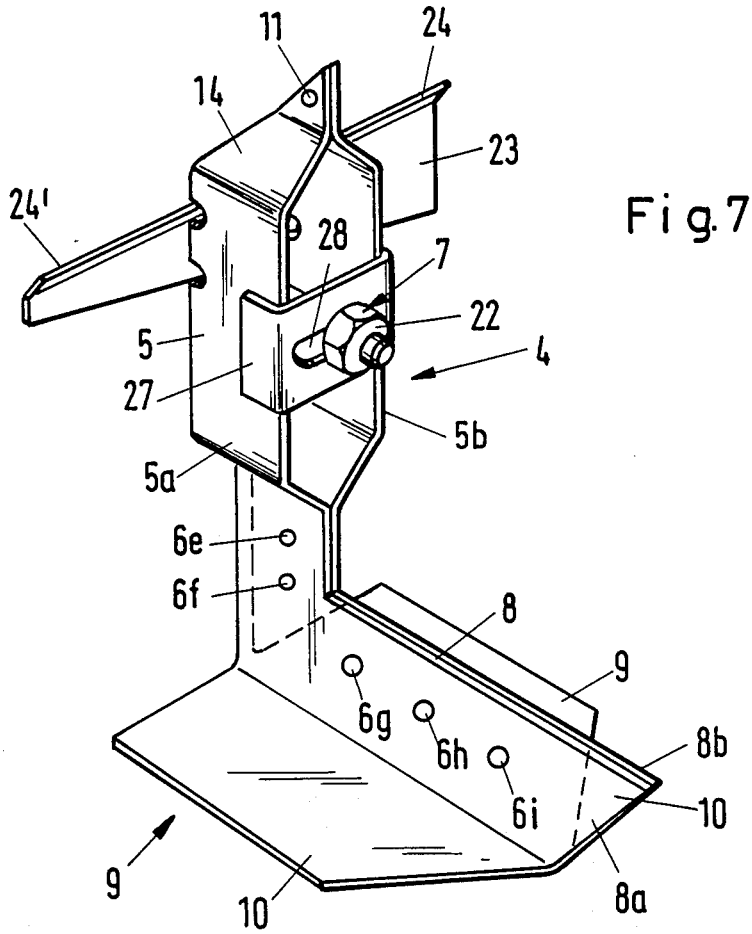
FIG. 7 shows a further alternate embodiment of the invention, which is provided in particular for ventilated curtain brick walls.

Finally, in the case of the embodiment according to FIG. 7, the bracing is formed by the welds 6*e* to 6*i* (electric welding spots).

Figure 4A:
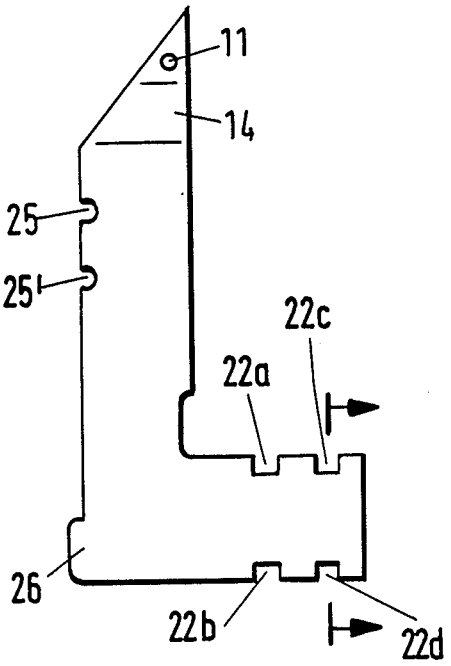
Figure 4B:
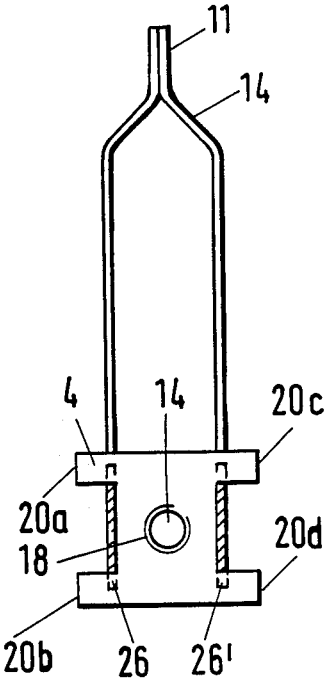

According to the embodiments 1, 1*a*, 4*a*, 4*b* and 5, a simple, very stable bracing is provided by inserting two spaced-apart parallel plates 6*a*, 6*b*, which are simultaneously designed as bearing plates between the supporting struts 8*a*, 8*b* in such a way that a support 9 with its threaded section 9' (see FIGS. 1, 1*a* and 5) is passed through said plates, a thread 18 being provided in at least one of the two plates for the threaded section 9' (FIG. 4*b*).

The bearing plates 6*a*, 6*b* may be connected in a suitable manner to the supporting struts 8*a*, 8*b*. For this it is advantageous (see FIGS. 1, 1*a*, 4*a*, 4*b* and 5) to provide notches 22*a*, 22*b* and/or 22*c*, 22*d* (FIG. 4*a*) in the supporting struts 8*a*, 8*b* for the suspension of a supporting plate 6*a* or 6*b* in each one.

The supporting plates themselves are designed approximately H-shaped, in such a way that at the top and the bottom project overhanging extensions 20*a*, 20*b* and/or 20*c*, 20*d*, which fit precisely into the correspondingly dimensioned recesses 22*a* to 22*d*, so that a positive and immovable firm retention for the bearing plates 6*a*, 6*b* is provided. It may be expedient for this purpose to upset or compress the plates 6*a*, 6*b* at the connecting points so that they can satisfactorily transfer the forces acting on them onto the horizontal supporting legs 8*a*, 8*b* without there being the risk of a loosening of the bracing.

This design has the advantage that the forces of weight of the slabs 1, 1' no longer go into a single bearing point which is highly stressed, as in the case in known prior art arrangements. Rather, the supporting forces are transferred in a mechanically favorable way onto two spaced-apart plates in such a way that only proportionate bearing forces, and thus slight loads, occur in each individual plate. This makes it possible to design the plates 6*a*, 6*b* as simple punched parts of flat material without special reinforcements having to be welded on for this purpose. The plates 6*a*, 6*b* are, furthermore, free from bending forces, so that they may be designed relatively thin and weight-saving. In addition, two successive bearing plates 6*a*, 6*b* for the support 9 simultaneously form a simple but effective bracing of the angular holder 4.

In the case of the embodiment according to FIG. 1*a*, the extensions 20*a*, 20*b* of each plate are punched not with rectangular recesses, but with oblique recesses 34. This makes it possible to compress the H-shaped plates 6*a*, 6*b* only on the lower side with the supporting struts 8a, 8b, as the oblique recesses 31 on the upper side of the plates 6a, 6b no longer require a compression. Thus, the hole 14 located in these plates (see FIG. 4b) for the passage of the threaded section 9' of the support 9 is not deformed during compression of the plates 6a, 6b in the region of the extensions 20a, 20b. The oblique recesses 34 make it possible for the plate to be inserted in oblique position between the supporting struts 8a, 8b and to brace itself between the holding struts 8a, 8b during vertical positioning, so that a special compression of the upper extensions 20a, 20b of the plates 6a, 6b is not necessary.

In the case of particularly highly stressed holding angles, or holding angles where extreme material saving is important, a further plate 6c may be provided as additional bracing in the rear region of the holding struts 6a, 6b as shown in the embodiments of FIGS. 1a, 1b, 2a to 2c, and 6.

For this purpose, the rear part of each holding strut 8a or 8b is provided with recesses 35 and 36, into which a similar approximately H-shaped plate 6c is inserted and subsequently compressed (see FIG. 1b). The plate 6c is formed for this purpose with corresponding extensions 37 and 38, which pass through the associated recesses 35 and 36 after insertion of the plate for subsequent compression. The overhanging, rear parts of the plates 6c simultaneously form lugs or extensions 26a, 26b, which project backward beyond the holder 4, and support the apparatus in an assembled state with respect to the anchorage base at two opposite points, thereby compensating for existing tolerances on the anchorage base.

For the passage of the anchorage element 7 (see, for example, FIGS. 1, 1a, 2a to 2c and 3a), a U-shaped clip 27 with a recess 28 is provided, through which, for example, the threaded bolt 7' of the anchorage element 7 passes. In the assembled state, the clip 27 is firmly braced against the vertical holding legs 5a, 5b by the screw 22.

In the case of the embodiments according to FIGS. 1, 1a, 3a and 5, the support 9, known per se, is provided at its free end with a level, flat mount 10, on which, for example, a natural stone slab 1 or the like rests (FIG. 3a). A pin 10a serves here to retain the resting slab. A pin 10b pointing in the opposite direction is likewise seated on the mount 10 and retains a natural stone slab located beneath it.

By adjusting the support 9 back and forward by means of its threaded section 9', the slabs 1, 1' held in front (FIG. 3a) can be brought into a position at a given distance from the masonry.

In the case of the embodiment according to FIGS. 1, 1a, 3a, 4a, 4b and 6, for horizontal adjustment of the support 9, its flat mount 10 must be turned at least through 180°. For this purpose, the counter nut 31 (FIG. 1) must be loosened and the slabs 1, 1' retained by the pins 10a, 10b must be removed during the horizontal adjustment. This readjustment is relatively laborious. Even if the slabs 1, 1' are not yet inserted into the pins 10a, 10b, there must be sufficient space available in the turning of this slab 1 for the horizontal adjustment of the support 9 by its flat mount 10.

Figure 5:
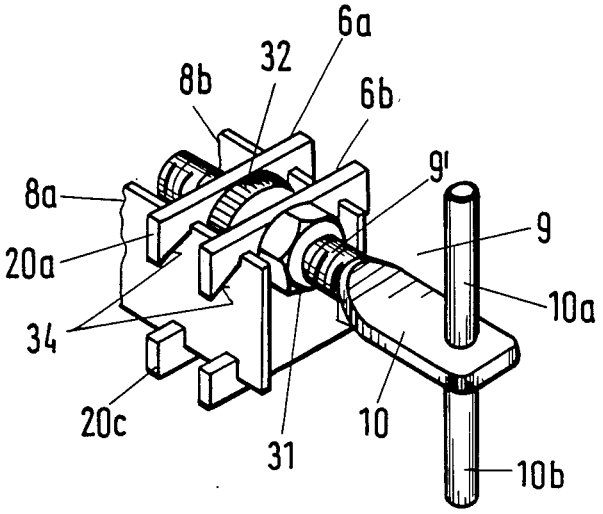
FIG. 5 shows an alternate design of the adjustment of the support.

To simplify this horizontal adjustment and to make possible an infinitely variable adjustment in minimum space, the design according to FIG. 5 is provided. Between the two bearing plates 6a, 6b a threaded, loosely rotatable knurled nut 32 is provided, with threaded section 9' of the support 9 passing through it. When this knurled nut is turned, the distance of the support 9 from the masonry 2 changes without the relatively wide mount 10 of the support 9 or the pins 10a, 10b seated on it being obstructive. This alternate embodiment considerably simplifies adjustment in the horizontal direction compared with the embodiment shown in FIG. 1 or 4b, in which a thread 18 is arranged in the immovably arranged bearing plate 6a.

The embodiment represented in FIGS. 2a, 2b and 2c is provided for the application in which the apparatus is fastened in the floor region and has to bear several slabs one on top of the other, for example, where slabs are arranged in front of a brick wall. The holders 4 are similar in design to the holders of FIGS. 1, 1a and 1b except that in order to avoid special configurations for each installation, horizontal supporting legs 8a, 8b can be formed of different lengths. The lengths can be graded in such a way that all wall distances encountered in practice can be bridged. Thus, for example, with three or five apparatuses with merely different length horizontal supporting legs 8a, 8b, all practically conceivable wall distances of the slabs from the anchorage base can be readily bridged without elaborate and expensive special configurations becoming necessary. In FIGS. 2a to 2c, the lengths of the horizontal supporting legs are denoted respectively by L1 to L3.

In the case of the angular holders 4 of FIGS. 2a to 2c, bracing is provided by plate 6c and by the horizontal plate 12a. The plate 12a may be designed relatively thin in comparison with the height of the horizontal supporting leg 8, and bears at its free end the mounting pins 10a, 10b for retention of the slabs 1, 1' lying one above the other. The plate 12a is firmly bolted onto the horizontal supporting legs 8a, 8b by means of the screw bolt 12c and a clip-shaped claw 12b. By loosening this connection, the plate 12a can be easily adjusted in the horizontal direction, in other words perpendicular to the wall. Parts 12a, 12b and 12c at the same time form the bracing for the horizontal supporting legs 8a, 8b.

As can also be seen from FIGS. 2a to 2c, longitudinal slots 39 can be pressed or rolled into the underside of the plate 12a and serve to guide the horizontal displacement of the plate on the upper edges of the supporting legs 8a, 8b. The edges of the supporting legs 8a, 8b engage in the slots 39 and guide the plate when the plate is moved in the horizontal direction.

According to a further essential feature of the invention, the apparatus for the anchorage of slabs is designed with a simplified adjustment device which makes possible an infinitely variable vertical adjustment, which is extremely simple from an assembly viewpoint even in the case of such apparatuses which are not designed as described in all parts, in particular not with regard to the design of the horizontal supporting legs.

Figure 3B:
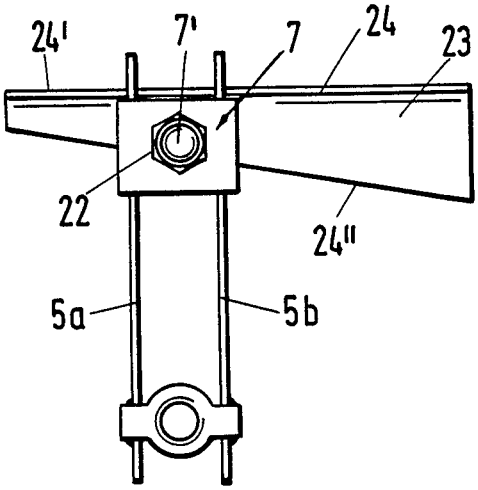

To be able to adjust an apparatus for the anchorage of slabs infinitely variably in a vertical direction in a simple way, instead of the known setting plates with toothings or oblique elongate holes, a simple wedge plate 23 is provided, referring to FIGS. 3a, 3b and 7. This continuous wedge plate 23 has a border 24, bent off toward the holder 4, with the outer edge 24' of the border engaging corresponding support recesses 25, 25' on the edges of the vertical holding struts 5a, 5b facing the anchorage base 2. The lower edge 24'' of the wedge plate 23 runs inclined or obliquely at a predetermined angle, and rests directly on the upper side of the anchorage element 7, a dowel or the like. By horizontal displacement of the wedge plate 23 the apparatus as a whole can thus be adjusted infinitely variably in the vertical direction in an extremely simple way. In this adjustment, the upper edge 24 of the wedge plate 23, which edge is advantageously bent off less than 90°, engages in a correspondingly designed recess 25 or 25' of the vertical holding leg 5*a* or 5*b* in such a way that the angular holder 4 is saddle-mounted on this bevelled edge 24 within the recess 25. In the lower region of the holder 4, namely at the rear end of the horizontal carrying struts 8, 8', there is provided on each a projecting extension 26, 26' (see also FIGS. 1, 4*a*) or 26*a*, 26*b* (FIG. 1*b*), by which the apparatus is held at an adequate distance A from the surface 3 of the anchorage base.

This creates a type of three-point bearing, with the force of weight acting on the apparatus via the recesses 25, 25' of the vertical holding legs 5*a*, 5*b* being transferred directly and without bending stress onto the wedge plate 23 which, due to its oblique lower edge 24'', rests directly on the anchorage element 7', whereby shearing force is transmitted to the anchorage element 7' and thus the anchorage base 2. The advantage of this design lies not only in the simple vertical adjustability by simple displacement of the plate 23 along the surface of the anchorage base, but in particular in the fact that the forces occurring are transferred by the shortest routes as compressive or shearing forces, avoiding bending stresses in the anchorage base, it being possible at the same time for tolerances caused by the construction to be readily compensated for owing to the three-point suspension.

The embodiment of FIG. 7 is, similar to that according to FIGS. 2*a* to 2*c*, provided for fastenings in the floor region, several slabs one on top of the other being loaded on a correspondingly designed support 10. It is particularly suitable for ventilated curtain brick walls and exhibits. The FIG. 7 embodiment is similar in many respects to the previously described embodiments. The horizontal supporting leg 8 consists of two parallel supporting struts 8*a*, 8*b*. These supporting struts and the vertical holding struts 5*a*, 5*b* consist of flat punched strips. The horizontal supporting struts 8*a*, 8*b* and the vertical holding struts 5*a*, 5*b* lie in vertical planes, i.e. they are upright to the surface of the anchorage base and are connected to each other, for example, by bracings. In the upper part, the holding struts 5*a*, 5*b* are connected to each other by spot welding 11. Below the anchorage, the vertical holding legs 5*a*, 5*b* run symmetrically towards each other and are firmly welded to each other by the spot weldings 6*e* to 6*i*. These welds 6*e* to 6*i* form bracings which give the apparatus the necessary stability and rigidity in the lower region. Advantageously, in the embodiment of FIG. 7, the support 9 for mounting the masonry building blocks is arranged on the horizontal supporting struts 8*a* or 8*b*. It may be punched out of the same flat material from which the supporting struts 8*a* and 8*b* possibly together with the holding struts 5*a* and 5*b*, are punched. By simple bending off by 90°, the support 9 with its mounting surfaces 10 for the masonry building blocks can be produced simply and easily.

The invention, as described above using individual exemplary embodiments, has the advantage that the apparatus as a whole, but in particular the spaced-apart angular holders, can be produced from simple strip material by way of punching as mass-produced articles. In this case, the recesses 25, 25', the lug-shaped extensions 26, 26' and the recesses 22*a* to 22*d* (FIG. 4*a*) can be formed in the angular holder in one operation. Owing to the deep webbed flat struts of the two vertical holding legs 5*a*, 5*b* positioned perpendicular to the anchorage base, and the likewise deep webbed horizontal supporting legs 8*a*, 8*b* and their position in parallel planes, the angular holder 4 altogether receives a very favorable moment of resistance. Thus, in spite of high stress, the holder can be produced from, in comparison with known apparatuses, thin, flat sheet metal parts with a minimum of material expenditure, especially as the parts necessary for bracing of the angular holder 4 are, in preferred design, likewise punched parts, such as simple plates or the like. Owing to the clearly arranged and simple structural design, the angular holder as a whole can be statically calculated more accurately in comparison with known apparatuses, so that its design and dimensioning can be precisely planned for the load. Consequently, the subject matter of the invention is characterized by high load-bearing strength and stability with a low dead weight and with optimally low stress by bending forces. The apparatus can therefore be produced easily and cheaply, preferably by punching from strip material, substantially consisting of two identical flat punched parts. The bracing of the two parallel, vertical holding legs and horizontal supporting legs by plate-shaped parts at the same time makes possible a simple bearing of the horizontally adjustable support without parts becoming necessary for this for which complicated bend-shaping is necessary.

What is claimed is:

1. An apparatus for the anchorage of loads such as slabs or the like to an anchorage base, comprising:

(a) a holder assembly comprised of a pair of separately formed, spaced, angular shaped holders, each holder comprising a flat vertical holding strut adapted to be positioned generally perpendicular to the surface of the anchorage base, and an integrally formed flat, generally horizontal supporting strut extending generally perpendicular to said vertical strut toward the load to be supported, said holders being spaced from and generally parallel to each other, said vertical holding struts including rearwardly projecting means in the lower regions thereof for contacting said anchorage base;

(b) means for securely bracing said holders in their spaced, parallel position, said bracing means comprising a pair of spaced, parallel bearing plates positioned between and secured to said horizontal supporting struts;

(c) anchoring means operatively connected to said holders for anchoring the same to said base; and (d) generally horizontally outwardly extending load support means operatively connected to said bearing plates and thus to said horizontal supporting struts of said holders, said load support means being adapted to support such loads and transfer, through said bearing plates and said holders, the force thereof to said anchorage base.

2. The apparatus as claimed in claim 1, wherein said horizontal supporting struts and said vertical holding struts are punched out of flat iron.

3. The apparatus as claimed in claim 1, wherein said vertical and horizontal struts of each holder are in the same vertical plane.

4. The apparatus as claimed in claim 1, wherein at least one of said bearing plates is formed with a threaded opening through which a threaded section of said support means extends.

5. The apparatus as claimed in claim 4, wherein a threaded bearing in the form of a freely rotatable adjustment screw nut is provided between said bearing plates and in threaded engagement with a threaded section of said support means, whereby said support means can be adjusted inwardly or outwardly.

6. The apparatus as claimed in claim 1, wherein said bearing plates are inserted firmly on said supporting struts by means of apertured extensions formed in said plates.

7. The apparatus as claimed in claim 6, wherein certain of said extensions have oblique edges running upward and inward toward the supporting struts.

8. The apparatus as claimed in claim 1, wherein, in the rear region of said supporting struts, a reinforcement plate is inserted in recesses formed in said supporting struts.

9. The apparatus as claimed in claim 1, further including means for vertically adjusting said holders, said adjusting means comprising a setting plate in the form of a continuous wedge plate with one border bent toward said holders, said holders being provided with supporting recesses on the edges of said vertical holding struts facing said base, said recesses receiving the edge of said border, said wedge plate having a lower edge which runs at an angle to the horizontal.

10. The apparatus as claimed in claim 9, wherein said border is bent at an angle of less than 90°.

11. The apparatus as claimed in claim 1, wherein said projecting means comprises a projecting lug formed in the lower region of each vertical holding strut for contact with the anchorage base.

12. The apparatus as claimed in claim 8, wherein said projecting lugs means comprise formed on said rear reinforcement plate.

13. The apparatus as claimed in claim 1, further including a clip extending over the vertical holding struts, said clip being formed with an elongated recess through which said anchoring means extends.

14. The apparatus as claimed in claim 1, wherein said load support means includes a flat mount portion having mounted theron a holding pin for the slabs to be supported.

* * * * *